US006715555B2

(12) United States Patent
Milberger et al.

(10) Patent No.: US 6,715,555 B2
(45) Date of Patent: Apr. 6, 2004

(54) SUBSEA WELL PRODUCTION SYSTEM

(75) Inventors: Lionel J. Milberger, Houston, TX (US); Darren W. T. Mills, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/280,847

(22) Filed: Oct. 26, 2002

(65) Prior Publication Data

US 2004/0020654 A1 Feb. 5, 2004

Related U.S. Application Data

(60) Provisional application No. 60/400,306, filed on Aug. 1, 2002.

(51) Int. Cl.[7] ..... E21B 29/12

(52) U.S. Cl. ..... 166/368; 166/337; 166/95.1; 166/325; 166/373

(58) Field of Search ..... 166/336, 337, 166/338, 339, 341, 368, 80.1, 95.1, 97.1, 151, 316, 325

(56) References Cited

U.S. PATENT DOCUMENTS 3,881,516 A * 5/1975 Childers et al. ..... 137/625.44
4,325,409 A * 4/1982 Roberts ..... 137/596.14
4,553,589 A * 11/1985 Jennings et al. ..... 166/53
4,796,922 A * 1/1989 Prichard ..... 285/26
4,962,812 A * 10/1990 Berzin ..... 166/187
5,145,006 A * 9/1992 June ..... 166/341
5,465,794 A * 11/1995 McConaughy et al. ..... 166/375
5,749,608 A * 5/1998 Wilkins et al. ..... 285/123.12
5,865,250 A 2/1999 Gariepy
5,868,204 A * 2/1999 Pritchett et al. ..... 166/368
5,884,708 A * 3/1999 Garcia-Soule et al. ..... 166/356
6,119,773 A * 9/2000 Gariepy et al. ..... 166/88.1
6,520,253 B2 * 2/2003 Calder ..... 166/84.4
6,598,680 B2 * 7/2003 DeBerry ..... 166/368

FOREIGN PATENT DOCUMENTS

GB 2119831 A * 11/1983

* cited by examiner

*Primary Examiner*—Robert E. Pezzuto
*Assistant Examiner*—Thomas A. Beach
(74) *Attorney, Agent, or Firm*—Loren Helmreich; Browning Bushman, P.C.

(57) ABSTRACT

A tubing hanger positioned within the bore of a wellhead body has a vertical bore from which a tubing string may be suspended within a well bore. When the hanger is landed, a fluid passageway in the tubing hanger has one end in fluid communication with a passageway in the wellhead body and its other end connected to a pressure responsive downhole function. The poppet valve mounted in the passageway is urged closed, and when opened permits fluid pressure from a source to be supplied to the function.

10 Claims, 6 Drawing Sheets

SUBSEA WELL PRODUCTION SYSTEM

This patent application claims the benefit of Provisional Application No. 60/400,306 filed Aug. 1, 2002 and entitled "Subsea Well Production System".

This invention relates generally to a subsea well production system which includes a wellhead body having a vertical bore in which a tubing hanger is landed to suspend a tubing string within the wellbore. More particularly, it relates to improvements in such a system wherein the tubing hanger is oriented into a desired rotational position within the bore of the wellhead body so as to align and seal the end of a fluid passageway therein with respect to the adjacent end of a fluid passageway in the body so that pressure fluid from a remote source may be supplied through the passageways to a fluid responsive function within the well, which may be a fluid responsive operator of a valve for use in opening and closing the tubing.

As shown and described in Patent No. 5,865,250, to ABB Vetco, for example, the wellhead body may be a spool of a so called "horizontal" tree, although this invention contemplates that it may be a part of more conventional wellhead equipment. In any event, the system includes an adapter for connecting the fluid pressure source with the outer end of the fluid passageway in the body, and thus through the fluid passageway in the hanger to the valve operator so as to maintain the tubing open as it is being run into the well. More particularly, the fluid passageway in the hanger has a normally closed poppet valve therein so that, following opening of the tubing, the pressure of the fluid may be reduced to permit the poppet valve to close and thereby contain fluid pressure supplied to the operator. At this time, the adapter may be removed from the hanger so as to permit the hanger to be lowered into a landed position within the body bore.

As known in the art, following installation of the hanger, fluid pressure on the valve operator may be vented in the event of an emergency or other predetermined condition so as to permit the valve to close the tubing. In order to permit the valve to be reopened, the source of pressure fluid is adapted to be connected to the outer end of the fluid passageway in the wellhead body whereby the poppet valve is opened so that such fluid may be supplied to the valve operator to reopen the tubing valve.

One problem with a system having an adapter of this type is the inability to test the sealing integrity of the poppet valve in the fluid passageway of the tubing hanger. Thus, there is no assurance that pressure fluid supplied to the tubing valve operator will not leak past the poppet valve, and thus permit the tubing valve to close, and of course, prevent the tubing valve from being reopened.

Hence, it is the primary object of this invention to provide equipment of this type wherein, following opening of the tubing, the sealing integrity of the poppet valve may be tested, and thus permit it to be repaired or replaced if necessary. More particularly, it is an object to provide such a system having an adapter of such construction as to make possible this and other advantages over the above described prior art. For this and other purposes, the tubing hanger passageway has a port intermediate the poppet valve and the pressure responsive downhole function and a recess in its outer side forming an outward continuation of the port, and an adapter having a valve member is removably mounted in the recess for movement between positions opening the adapter and closing the port. More particularly, the adapter also has a flow passage to which a second source of pressure fluid may be connected for supplying such fluid through the port to the fluid passageway of the hanger when the valve member is open, whereby the sealing integrity of the closed poppet valve may be tested.

More particularly, in one illustrated embodiment of the invention, a body in which the flow passage is formed is releasably connected to the recess to mount the valve member for movement between open and closed positions, and an actuator is mounted on the body in torque transmitting relation with the valve member to move it between opened and closed positions.

In another illustrated embodiment of the invention, the adapter includes an actuator releasably connected to the valve member for selectively moving the valve member between opened and closed positions, and the flow passage is formed in the valve member and actuator which are sealed with respect to one another and the recess.

In accordance with another novel aspect of this invention, a cap is provided for releasable connection to the recess to cover the closed valve member upon removal of the body and actuator. Preferably, and as illustrated, the body is threadedly connected to the recess, and the cap is releasably connectible to the recess by the threads to which the body is releasably connected.

Putting it another way, the port in the tubing hanger connects at one end with the fluid passageway in the hanger, and the adapter is reasonably mounted on the hanger for connecting the other end of the port with the second source of fluid pressure as the tubing is lowered in order to supply such fluid through the port when the valve is open, and test the sealing integrity of the poppet valve, so that, with the poppet valve closed, the adapter may be removed from the hanger.

In the drawings, wherein like reference characters are used throughout to designate like parts;

Figure 1A:
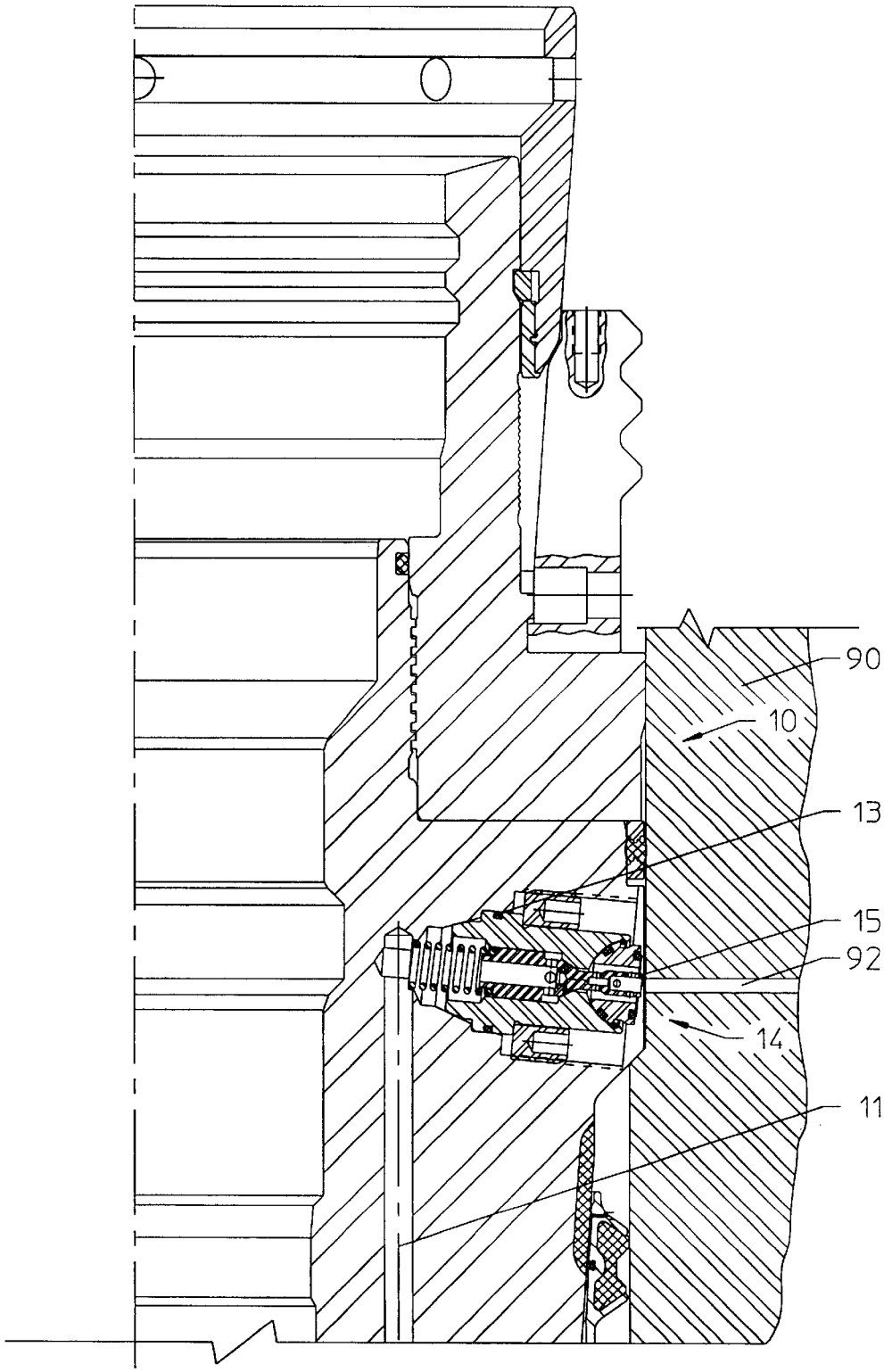
FIGS. 1A and 1B are vertical sectional views of the upper and lower ends of one side of a tubing hanger on which the adapter of the present invention is installed, prior to the tubing being Pin into the wellbore.
Figure 1B:
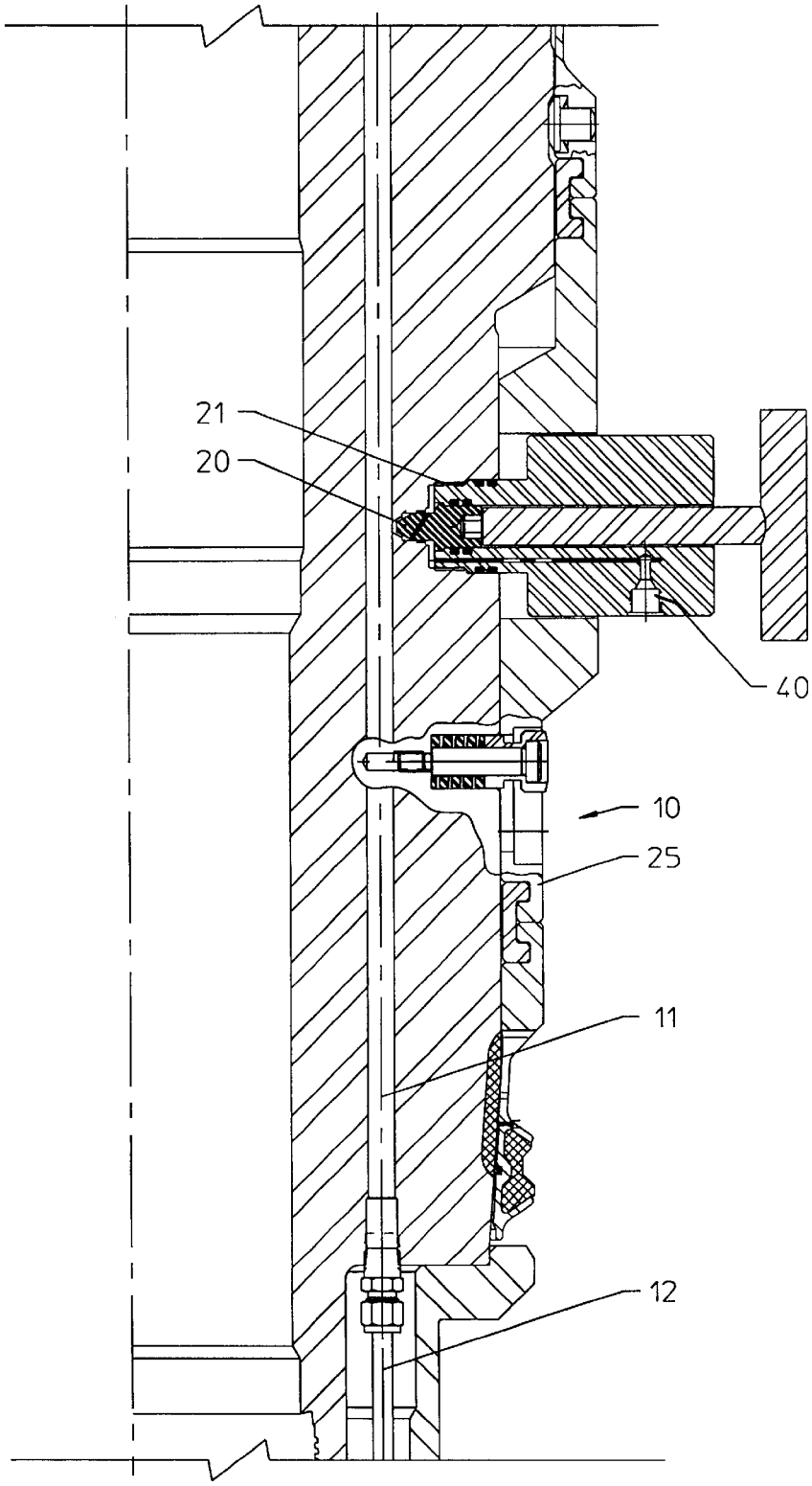

With reference now to the details of the above described drawings, and particularly FIGS. 1A and 1B, following opening of the tubing valve by use of the adapter of the present invention, as will be described to follow, the tubing hanger 10 is adapted to be landed on a shoulder within the bore of a wellhead 90 having a vertical bore for receiving the tubing hanger, and a lateral bore 92 for connection with a source of fluid pressure. As known in the art, parts on the hanger and bore cooperate with one another to properly orient the outer end of a lateral portion of a fluid passageway 11 in the hanger with respect to an adjacent end of a fluid passageway in a wellhead member to which the source of pressure fluid is adapted to be connected.

As known in the art, the fluid passageway 11 in the hanger includes a vertical portion connecting with a tube 12 leading to the operator for the tubing valve. More particularly, as shown herein and in co-pending application Ser. No. 10/178,747 filed Jun. 24, 2002 and incorporated by reference herein, an insert 13 installed in the lateral portion of the fluid passageway has a flow passage which is normally closed by a poppet valve 14 mounted on a stem 15 extending through the flow passage of the insert. A spring urges the poppet valve to closed position in which the end of the stem is positioned for engagement with the bore of the wellhead member so as to automatically open the poppet valve as the tubing hanger is landed, whereby fluid pressure from the remote source may be supplied through the passageway 11 to the tubing valve operator.

Figure 2:
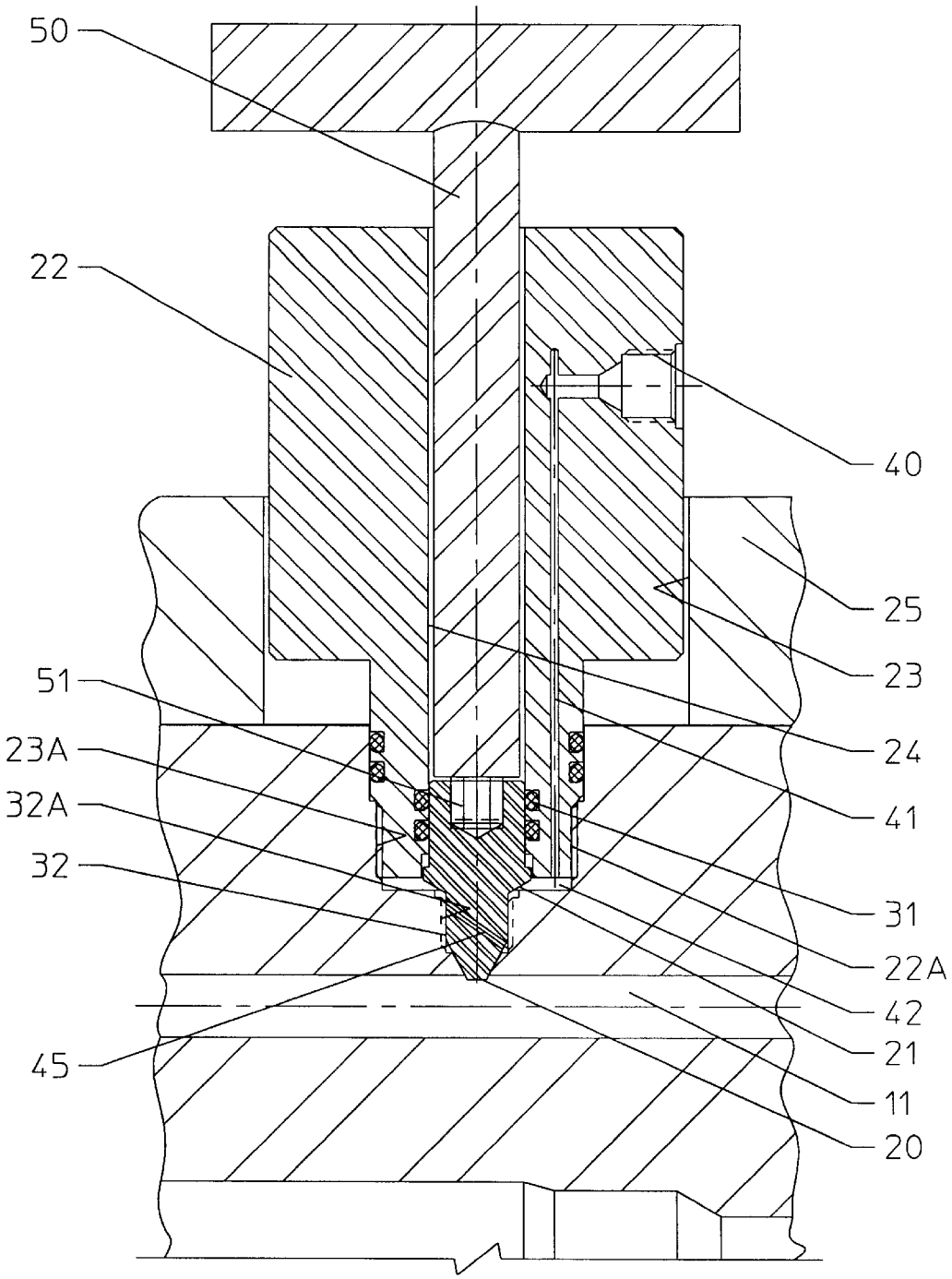
FIG. 2 is an enlarged cross-sectional view of the adapter with the valve member in a position closing the port connecting with the fluid passageway in the tubing hanger.
Figure 3:
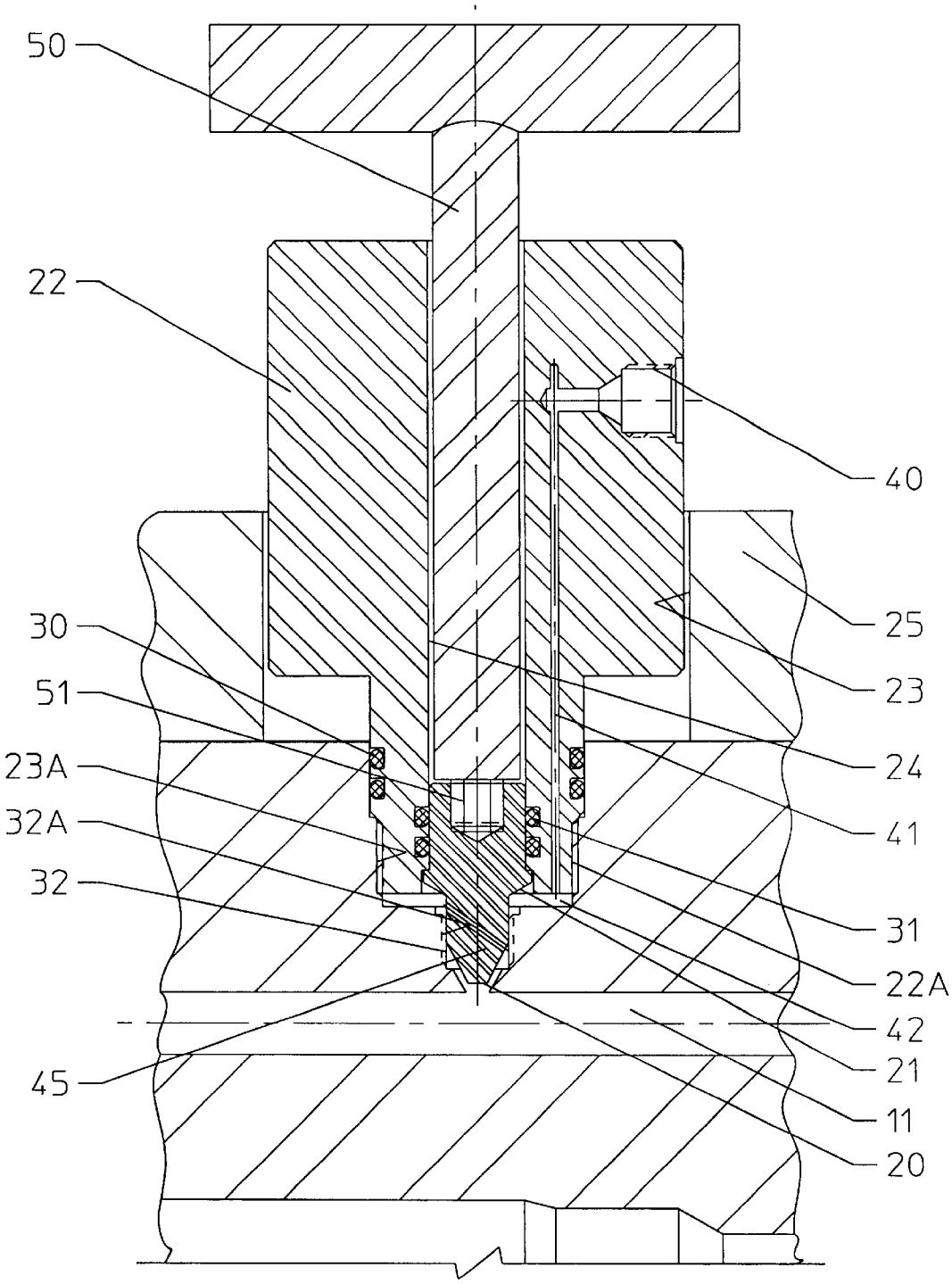
FIG. 3 is a view similar to FIG. 2, but in which the valve member has been moved to an open position to permit pressure fluid from a remote source to be supplied through the port to the operator of the tubing safety valve.

In any event, and in accordance with the present invention, the tubing valve is held open as the tubing is lowered into the wellhead bore, by a second adapter installed on the side of the tubing hanger in position to open and close a port 20 in the vertical section of the fluid passageway intermediate the poppet valve and the operator for the tubing safety valve. As shown in detail in FIGS. 2 and 3, the adapter includes a valve member 21 which is moveable between positions opening and closing the port. Preferably, the valve member has a conically shaped end which engages a conically shaped inner extension of the port to form a metal-to-metal seal therewith.

The valve member is mounted in a body 22 releasably connected within a recess 23 in the outer side of the tubing hanger generally coaxially of the port. More particularly, the recess includes an inner threaded portion 23A to receive the inner threaded end 22A of the body, and the valve member is in turn mounted in the inner end of a bore 24 through the body for movement toward and away from the port to open and dose it as its conically shaped end is moved into and out of metal to metal sealing engagement with a conical seat on the inner end of the port. The enlarged outer portion of the body is received closely within the enlarged outer end of the recess formed in a sleeve 25 mounted about the lower portion of the hanger body.

The adapter body is sealed with respect to the reduced recess in the hanger by means of seal rings 30 and with respect to the valve member by seal rings 31. The valve member may be moved between the port closing position of FIG. 2 and port opening position of FIG. 3 by means of threads 32 about the reduced inner end of the valve member engaging threads 32A on the inner end of the recess. Opposed shoulders on the valve member and port 20 locate the valve member in its open position of FIG. 3.

As previously described, a port 40 is formed in the adapter body to connect at its outer end with a remote source of pressure and at its inner end with a flow passage 41 extending radially inwardly to connect with a space 42 between the inner end of the adapter body and the inner end of the reduced portion of the recess in the hanger. When the valve is moved to the port opening position of FIG. 3, fluid from the remote source may be admitted to the space and thus through the port 20 to the operator for the tubing valve, as well as upwardly within the fluid passageway 11 in the tubing hanger to the poppet valve. Thus, a hole 45 is formed in the inner reduced end of the valve member to connect the inner threaded end of the body opening for the stem and the valve member with the aforementioned space 42 connecting with the source of pressure, so that, when the valve member is open, pressure fluid is free to pass through the open port 20.

The outer end of the bore 24 through the adapter body is adapted to receive the stem 50 of an actuator having an out of round torque transmitting connection 51 with the outer end of the valve member, whereby the valve member may be moved between open and closed position by rotation of the stem. As noted, outward movement of the valve member to its open position is limited by oppositely facing shoulders about it and the bore in the valve body through which stem 50 extends.

Opening of port 20 permits the pressure fluid to flow from the source and through port 40 into the fluid passageway 11 for the purpose of opening the tubing valve, and, of course, testing the poppet valve. Assuming the closed poppet valve does not leak, the valve member may be moved back to its closed position of FIG. 2, at which time the remote source of pressure may be disconnected from the adapter body, and the valve body and the actuator removed from outside of the hanger.

Figure 4:
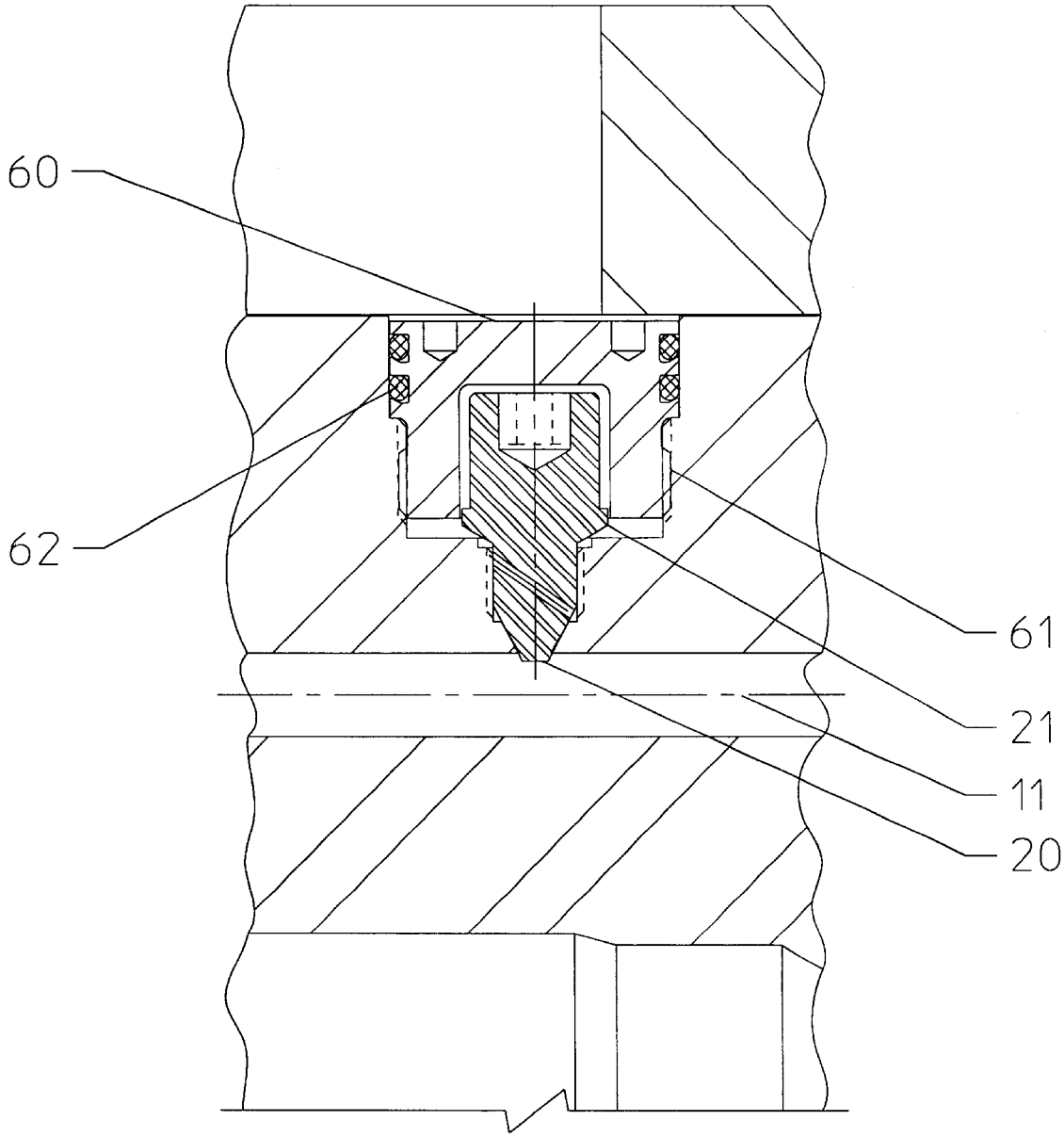
FIG. 4 is an enlarged sectional view showing the body of the adapter removed, and a protective cap installed within the hanger recess to cover and thus protect and provide a secondary seal for the closed valve member.

At this time, and in accordance with another novel aspect of the invention and as shown in FIG. 4, a protective cap 60 may be installed over the outer end of the closed valve member. For this purpose, the inner end of the cap has threads 61 which engage the threads to which the inner end of the adapter body was connected. The cap carries seal rings 62 for sealably engaging the reduced end of the cavity in the tubing hanger in order to contain fluid pressure in the event there is leakage through the port 20. The hanger may then be lowered into the wellhead bore for landing therein.

Figure 5:
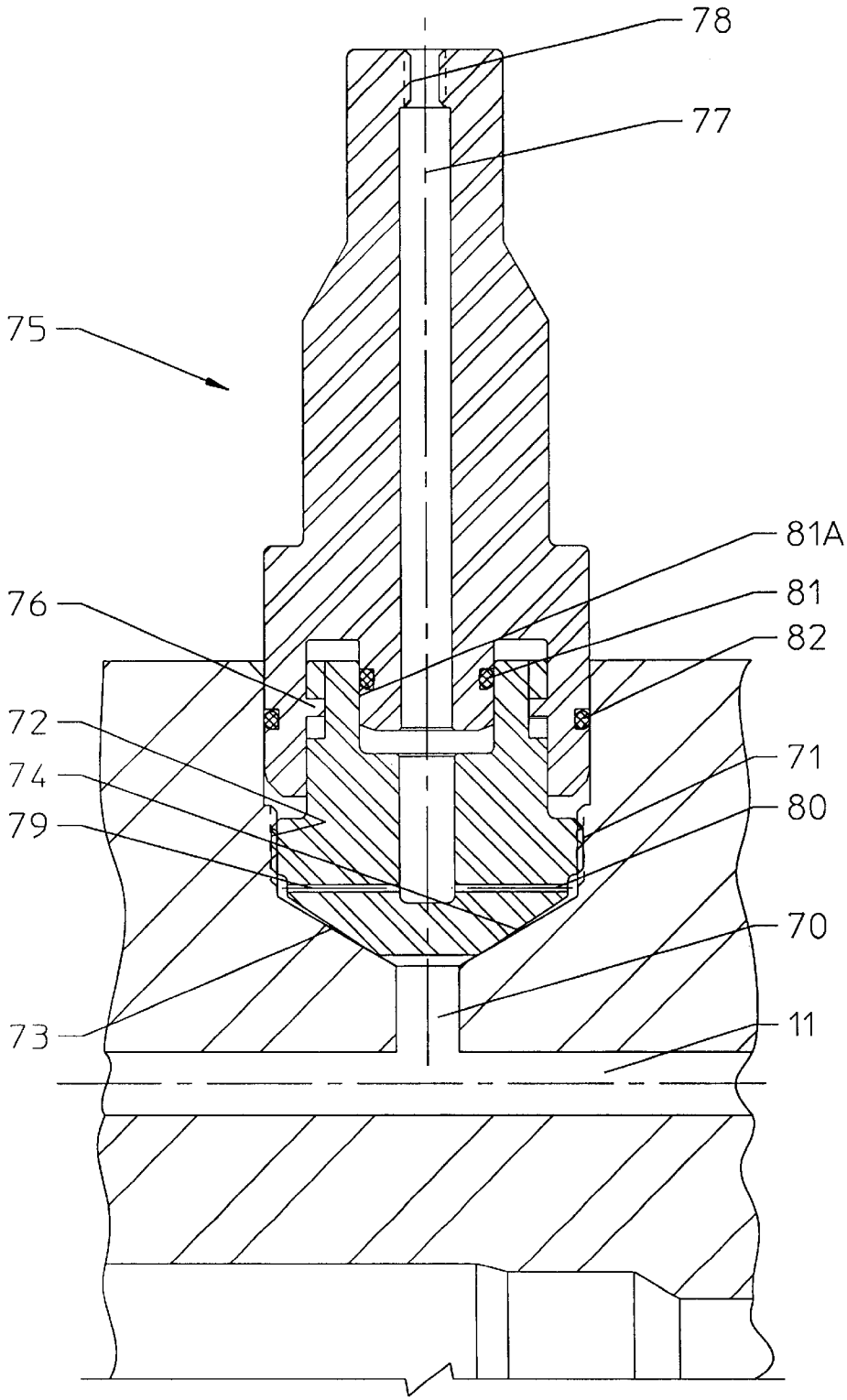
FIG. 5 is an enlarged sectional view of the alternative form of adapter.

In an alterative embodiment of the adapter shown in FIG. 5, a port 70 in the fluid passageway 11 of the hanger is adapted to be opened and dosed by means of an adapter having a valve member 71 in the form of a plug threadedly connected to the inner end of a recess 72 formed in the outer side of the hanger.

The valve member has a conically shaped end 73 whose inner end forms a metal-to-metal seal with the conical extension 74 of the port when in Rs closed position.

The valve member is moved between open and closed position by means of an actuator 75 received in the outer end of a hanger recess and releasably connected with the outer end of the valve member by a J-slot of a well known construction which permits the actuator to be selectively connected or removed from the valve member and, when so connected, rotated in opposite directions to open or close the valve member.

More particularly, a flow passage 77 through the actuator connects with an aligned flow passage 78 in the valve member, which in turn connects with lateral holes 79 through the valve member leading to a space 80 between the threaded connection 71 of the valve member and the inner end of the recess. The outer end of the passage has a port 78 to which a source of fluid under pressure may be releasably connected for passage through the port 70 when the valve member is open.

As shown, with the actuator releasably connected to the valve member by means of the J-slot, a seal ring 81 thereof engages a recess 81A in the outer end of the valve member, and a seal ring 82 thereof sealably engages the recess in which the actuator is received. These seals maintain sealing engagement between the actuator, valve member and recess to confine fluid flow between the source and the port 78 as the actuator is rotated to move the valve member between the dosed position of FIG. 5 and an open position in which Rs inner end is raised from metal to metal engagement with the inner extension 74 of the recess.

When the valve member is in open position, pressure fluid is supplied through the port 78, passageways 77 and 77A, and holes 79 to the space 80, and thus to the operator for the tubing valve to hold it open prior to the tubing being lowered into wellhead body. As in the case of the prior embodiment of the adapter, such pressure also tests the sealing integrity of the poppet valve in the fluid passageway of the hanger. The valve may then be moved to closed position to permit the actuator and source of fluid pressure to be removed so that the hanger may be lowered into landed position in the bore of the wellhead body.

In each embodiment, the metal to metal seal of the valve member with the tubing hanger recess may be tested from the back side prior to removal of the actuator and source. A cap (not shown) may be provided for protecting the closed valve member, as in the first embodiment, following removal of the adapter.

Although the invention has been described in detail, it should be understood that this explanation is for illustration, and that the invention is not limited to these embodiments. Alternate components and installation techniques will be apparent to those skilled in the art in view of this disclosure. Additional modifications are thus contemplated and may be made without departing from the spirit of the invention, which is defined by the claims.

What is claimed is:

1. An assembly for operating a pressure responsive downhole function of a subsea well production system, comprising:

a wellhead body having a vertical bore therethrough and a lateral fluid passageway for connecting the vertical bore with a remote source of pressure fluid;

a tubing hanger adapted to be lowered into a landed position with the vertical bore of the wellhead body, the tubing hanger having a tubing vertical bore for communication with a tubing string suspended within a well bore, and a tubing fluid passageway which, when the tubing hanger is landed in the bore of the wellhead body, is oriented into a desired rotational position in which one end is in sealed fluid communication with the lateral fluid passageway in the wellhead body and an opposing end in fluid communication with the pressure responsive function;

a poppet valve mounted in the tubing fluid passageway in the tubing hanger and adapted, when open, to permit fluid pressure from the remote source to be supplied to the pressure responsive function;

a port connecting with the tubing fluid passageway with the pressure responsive function;

an adapter body with an adapter bore therein and sealably and removably mounted on the tubing hanger to connect the adapter bore with the port, a valve member mounted on the adapter body for movement to selectively close and open the port to the adapter bore;

an actuator for moving the valve member;

the adapter body having an adapter port for connecting the port with another source of pressure fluid, so that, when the valve member is open, fluid from another source may be introduced into tubing passageway in the body hanger to test the sealing integrity of the closed poppet valve, and, when the valve member is closed, the adapter may be removed from the tubing hanger.

2. An assembly as defined in claim 1, wherein:

the valve member comprises a plug threadedly mounted within a recess in an outer surface of the tubing hanger for movement between positions opening and closing the port to the adapter bore; and the actuator including a torque transmitting connection for engagement with the plug for moving the plug between the opened and closed positions.

3. An assembly as defined in claim 1, further comprising:

a cap which, upon removal of the adapter body and the actuator, is sealably connected to the adapter bore so as to cover and thereby protect the valve member.

4. An assembly as defined in claim 2, wherein:

the actuator includes an actuator body sealably mounted within an opening in the adapter body; and the plug has an opening connecting at one end with the adapter port and, at its other end, with the port so that fluid pressure from the another source may flow into the hanger passageway when the plug is in an open position.

5. An assembly as defined in operating a tubing safety valve of a subsea well production system, comprising:

a wellhead body having a vertical bore therethrough and a lateral fluid passageway therein for connecting the vertical bore with a remote source of pressure fluid;

a tubing hanger adapted to be lowered into a landed position within the vertical bore of the wellhead body, the tubing hanger having a tubing vertical bore for communication with a tubing string suspended within a well bore;

a safety valve within the tubing vertical bore adapted to be opened and closed by a pressure responsive operator;

the tubing hanger including a tubing fluid passageway which, when the tubing hanger is landed in the bore of the wellhead body, is oriented into a desired rotational position in which its end is in sealed fluid communication with the lateral fluid passageway in the wellhead body, and an opposing end with the pressure responsive operator;

a poppet valve mounted in the tubing fluid passageway in the tubing hanger and adapted, when open, to permit fluid pressure from the remote source to be supplied to the pressure responsive operator to hold the safety valve open, and, when closed, to permit the pressure responsive operator to remain pressurized;

a port connecting with the tubing fluid passageway with the pressure responsive operator;

an adapter body with an adapter bore therein sealably and removably mounted on the tubing hanger to connect the adapter bore with the port;

a valve member mounted on the adapter body for movement to selectively close and open the port to the adapter bore;

an actuator mounted on the adapter body for moving the valve member; and the adapter body having an adapter port for connecting the port with another source of pressure fluid, so that, when the valve member is open fluid from another source may be introduced into the tubing passageway in the tubing hanger, to test the sealing integrity of the poppet valve, and the valve member then closed to permit the adapter to be removed from the tubing hanger, while holding pressure to the operator.

6. An assembly as defined in claim 5, wherein:

the valve member comprises a plug threadedly mounted within a recess in an outer surface of the tubing hanger for movement between positions opening and closing the adaptor; and the actuator including a torque transmitting connection for engagement with the plug for moving the plug between the opened and closed positions.

7. An assembly as defined in claim 6, further comprising:

a cap which, upon removal of the adapter body and the actuator, is sealably connected to the adapter bore so as to cover and thereby protect the valve member.

8. An assembly as defined in claim 5, wherein:

the actuator includes an actuator body sealably mounted within an opening in the adapter body; and the plug has an opening connecting at one end with the adapter port and, at its other end, with the port so that fluid pressure from the another source may flow into the hanger passageway when the plug is in an open position.

9. An assembly as defined in operating a pressure responsive downhole function of a subsea well production system, comprising:

a tubing hanger adapted to be lowered into a landed position within a bore of a body and having a tubing vertical bore for communication with a tubing string suspended within a well bore;

a fluid passageway connected at one end with the pressure responsive function and at an opposing end with a first source of pressure fluid to be supplied to the downhole function;

a poppet valve within the fluid passageway to supply pressurized fluid when open, and to hold the pressure on the downhole function when closed;

an adapter body removably mounted on the tubing hanger for connecting the fluid passageway with a second source of pressure; and a valve member on the adapter body adapted to be moved between positions opening and closing the second source to the port, so that, when open, the second source of pressure fluid is supplied to the downhole function to test the sealing integrity of the poppet valve, and, when closed, permit the adapter body to be removed from the tubing hanger while holding pressure to the downhole function.

10. An assembly as defined in claim 9, further comprising:

a cap which, upon removal of the adapter body and the actuator, is sealably connected to the adapter bore so as to cover and thereby protect the valve member.

* * * * *